US011745207B2

(12) United States Patent
Crawford et al.

(10) Patent No.: US 11,745,207 B2
(45) Date of Patent: Sep. 5, 2023

(54) SPRINKLER WITH MODULAR COMPONENTS AND POP UP DEFLECTOR WITH LUG(S) FOR ROTATIONAL ENGAGEMENT

(71) Applicant: Nelson Irrigation Corporation, Walla Walla, WA (US)

(72) Inventors: Steven E. Crawford, Walla Walla, WA (US); Andrew B. Hellie, College Place, WA (US); Craig B. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 220 days.

(21) Appl. No.: 16/920,952

(22) Filed: Jul. 6, 2020

(65) Prior Publication Data

US 2020/0331019 A1 Oct. 22, 2020

Related U.S. Application Data

(63) Continuation-in-part of application No. 16/521,785, filed on Jul. 25, 2019, now Pat. No. 11,325,147, (Continued)

(51) Int. Cl.
*B05B 15/16* (2018.01)
*B05B 3/00* (2006.01)
(Continued)

(52) U.S. Cl.
CPC ..... *B05B 15/16* (2018.02); *B05B 3/003* (2013.01); *B05B 3/005* (2013.01); *B05B 3/0486* (2013.01);
(Continued)

(58) Field of Classification Search
CPC ..... B05B 15/16; B05B 15/65; B05B 15/50; B05B 3/003; B05B 3/005; B05B 3/0486; B05B 3/063; B05B 15/74; B05B 1/323
(Continued)

(56) References Cited

U.S. PATENT DOCUMENTS 2,488,234 A 11/1949 Perry
2,979,271 A 4/1961 Boyden
(Continued)

FOREIGN PATENT DOCUMENTS

CN 1040334 A 3/1990
CN 2571496 Y 9/2003
(Continued)

OTHER PUBLICATIONS

Indian First Examination Report dated Dec. 2, 2019 issued in Indian Patent Application No. 201714042324, 6 pp.
(Continued)

*Primary Examiner* — Christopher S Kim
(74) *Attorney, Agent, or Firm* — NIXON & VANDERHYE P.C.

(57) ABSTRACT

A sprinkler includes a pop-up deflector plate that is engageable with a brake assembly in an extended position. A brake module is secured to a sprinkler body and includes a rotatable connector coupled with the brake assembly. The pop-up deflector plate is disposed adjacent the nozzle and engages the rotatable connector in the extended position.

17 Claims, 22 Drawing Sheets

Related U.S. Application Data which is a continuation of application No. 15/365,461, filed on Nov. 30, 2016, now Pat. No. 10,399,108.

(51) Int. Cl.

| | |
|---|---|
| ***B05B 3/04*** | (2006.01) |
| ***B05B 15/65*** | (2018.01) |
| ***B05B 3/06*** | (2006.01) |
| ***B05B 15/50*** | (2018.01) |
| *B05B 1/32* | (2006.01) |
| *B05B 15/74* | (2018.01) |

(52) U.S. Cl.

CPC ..... *B05B 3/063* (2013.01); *B05B 15/50* (2018.02); *B05B 15/65* (2018.02); *B05B 1/323* (2013.01); *B05B 15/74* (2018.02)

(58) Field of Classification Search

USPC ..... 239/222, 222.11, 222.17, 251, 252, 253, 239/256, 257, 397, 442

See application file for complete search history.

(56) References Cited

U.S. PATENT DOCUMENTS

| | | | | |
|---|---|---|---|---|
| 3,888,417 | A | 6/1975 | Harmon | |
| 4,540,125 | A | 9/1985 | Gorney et al. | |
| 4,637,549 | A | 1/1987 | Schwartzman | |
| 4,886,211 | A | 12/1989 | Cohen | |
| 4,984,740 | A | 1/1991 | Hodge | |
| 5,007,586 | A | 4/1991 | Cohen | |
| 5,377,914 | A | 1/1995 | Christen | |
| 5,415,348 | A | 5/1995 | Nelson | |
| 6,827,291 | B2 | 12/2004 | Townsend | |
| 7,395,977 | B2 | 7/2008 | Pinch et al. | |
| 7,789,323 | B2 * | 9/2010 | Nelson | B05B 3/005 239/222.11 |
| 8,434,695 | B2 | 5/2013 | Barzuza | |
| 8,998,109 | B2 * | 4/2015 | Katzman | B05B 3/0486 239/222.11 |
| 10,399,108 | B2 | 9/2019 | Crawford et al. | |
| 2004/0050955 | A1 | 3/2004 | Sesser et al. | |
| 2006/0108445 | A1 | 5/2006 | Pinch et al. | |
| 2009/0321537 | A1 | 12/2009 | Nelson et al. | |
| 2011/0114755 | A1 | 5/2011 | Katzman et al. | |
| 2013/0270361 | A1 | 10/2013 | Clark et al. | |

FOREIGN PATENT DOCUMENTS

| | | | |
|---|---|---|---|
| CN | 1980745 | A | 6/2007 |
| CN | 201783413 | U | 4/2011 |
| CN | 107442309 | A | 12/2017 |
| EP | 1389490 | A1 | 2/2004 |
| KR | 10-1693260 | | 12/2016 |
| WO | WO 2004/085077 | | 10/2004 |

OTHER PUBLICATIONS

Brazilian Office Action dated Apr. 8, 2021 issued in Brazilian Patent Application No. BR 102017025881-5, 4 pp.

Chinese Office Action dated Aug. 9, 2022 issued in Chinese Patent Application No. 202110755153.7 and English Translation, 17 pp.

* cited by examiner

SPRINKLER WITH MODULAR COMPONENTS AND POP UP DEFLECTOR WITH LUG(S) FOR ROTATIONAL ENGAGEMENT

CROSS-REFERENCES TO RELATED APPLICATIONS

This application is a continuation-in-part (CIP) of U.S. patent application Ser. No. 16/521,785 filed Jul. 25, 2019, which is a continuation of U.S. patent application Ser. No. 15/365,461, filed Nov. 30, 2016, now U.S. Pat. No. 10,399,108, issued Sep. 3, 2019, the entire contents of each of which are hereby incorporated by reference in this application.

STATEMENT REGARDING FEDERALLY SPONSORED RESEARCH OR DEVELOPMENT (Not Applicable)

BACKGROUND

The invention relates to a modular industrial sprinkler including a pop-up deflector and, more particularly, to a selectively configurable sprinkler assembly with a pop-up deflector that is operable as a rotator or a spinner.

Industrial sprinklers with exposed nozzles may be prone to clogging due to debris that may collect in or around the nozzle. Blocked nozzles detrimentally affect sprinkler patterns and are time-consuming to clean and maintain. Debris may similarly collect around a spinning deflector plate, which can slow or jam the deflector plate.

BRIEF SUMMARY

It would thus be desirable to provide a sprinkler assembly including a pop-up deflector that protects the nozzle during periods of non-use. It would also be desirable to incorporate the pop-up deflector in a rotator assembly, including a brake or the like, to better control sprinkler patterns during use. It would still further be desirable for a sprinkler assembly to be constructed using modular components that are selectively configurable to achieve different characteristics for a sprinkler assembly.

In an exemplary embodiment, a sprinkler includes a sprinkler body, a brake module secured to the sprinkler body and including a rotatable connector coupled with a brake assembly, a nozzle module cooperable with the sprinkler body and including a nozzle, and a deflector plate cooperable with the nozzle module and disposed adjacent the nozzle. The deflector plate is displaceable in the nozzle module between a retracted position and an extended position. The deflector plate includes a stream deflector surface, a torque shaft, and a connection member, where the connection member engages the rotatable connector in the extended position.

The connection member may include a lug on a side of the deflector plate facing the rotatable connector. The rotatable connector may include at least one notch, where the lug may engage the at least one notch in the extended position. The connection member may include a plurality of lugs on a side of the deflector plate facing the rotatable connector. In this context, the rotatable connector may include a plurality of notches, and the lugs may engage the notches in the extended position.

In some embodiments, in the retracted position, the connection member may be spaced from and disengaged from the rotatable connector.

The rotatable member may include a channel, and the torque shaft may be disposed in the channel in the extended position. The channel may be an open channel or a closed channel.

The nozzle module may include a nozzle top coupled with a nozzle base, and the deflector plate may be displaceable between the retracted position and the extended position in the nozzle top. The rotatable connector may be positioned so as to act as a stop limit for the deflector plate in the extended position.

In another exemplary embodiment, a sprinkler includes a sprinkler body, a brake module secured to the sprinkler body and including a rotatable connector coupled with a brake assembly, a nozzle, and a pop-up deflector plate disposed in a path of a stream emitted from the nozzle and displaceable between a retracted position and an extended position. The pop-up deflector plate engages the rotatable connector in the extended position, and the pop-up deflector plate includes connecting structure that positively engages the rotatable connector in the extended position and that disengages from the rotatable connector in the retracted position.

The connecting structure may include one of a torque shaft and a lug on a side of the pop-up deflector plate facing the rotatable connector.

BRIEF DESCRIPTION OF THE DRAWINGS

These and other aspects and advantages will be described in detail with reference to the accompanying drawings, in which:

FIG. 28 is a cross-sectional view of the variation shown in FIG. 27;

DETAILED DESCRIPTION

Figure 1:
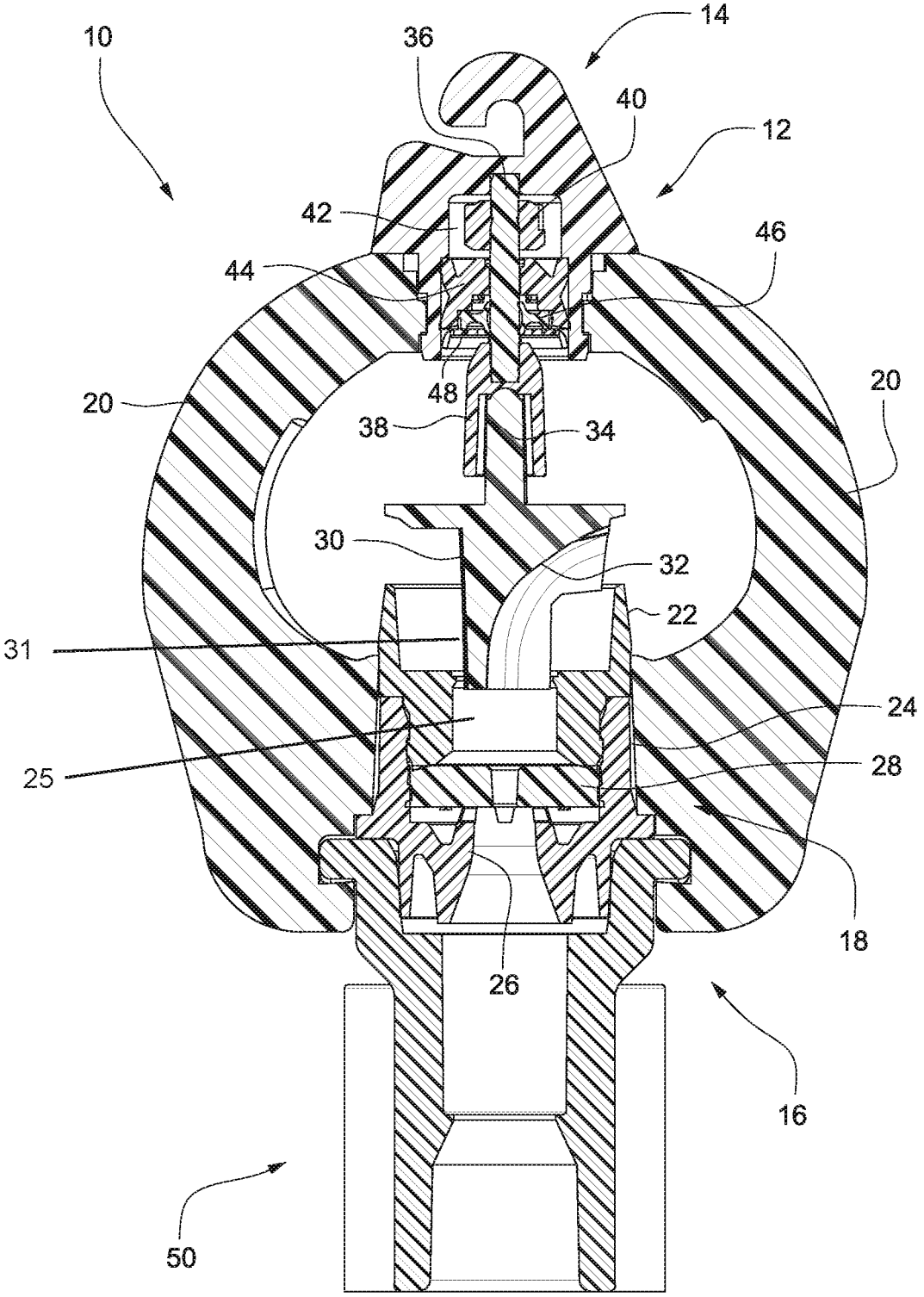
FIGS. 1 and 2 are sectional views of a sprinkler assembly according to one embodiment.

The sprinkler of the described embodiments results in a lower cost pop-up sprinkler that is configurable either as a rotator (i.e., incorporating a brake to control rotation speed) or a spinner (i.e., freely rotating). The sprinkler includes modular components so that the nozzle, deflector and brake functions can be varied according to user specifications. In a rotator configuration, the pop-up deflector plate is engageable in an extended position with a brake assembly. The brake module is secured to a sprinkler body and includes a rotatable connector coupled with the brake assembly. The pop-up deflector plate is disposed adjacent the nozzle and engages the rotatable connector in the extended position. With the modular construction, the brake assembly can be interchanged with a spinner assembly. Additionally, the nozzle module may or may not be provided with flow control structure and similarly may be interchanged with an alternative nozzle module. Still further, the deflector plate can be interchanged with alternative deflector plates to reflect desired sprinkler patterns.

FIGS. 1-4 show an exemplary configuration. The sprinkler includes a sprinkler body 10 that serves as connecting structure for the modular components of an assembled sprinkler. The sprinkler body 10 includes a first compartment 12 for securing a brake module 14 and a second compartment 16 for securing a nozzle module 18. The nozzle module 18 may be connected to the sprinkler body 10 in a snap fit. Sprinkler body arms 20 extend between the first and second compartments 12, 16.

The nozzle module 18 includes a nozzle top 22 engaged with a nozzle base 24. In some embodiments, the nozzle top 22 is coupled with the nozzle base 24 in a snap fit. The nozzle top 22 includes a deflector plate receiving channel 25. The nozzle base 24 may include an integrated nozzle 26 through which a stream of water is emitted. A flow washer 28 may be included to provide flow control from the nozzle 26.

A deflector plate 30 is cooperable with the nozzle module 18 and is disposed adjacent the nozzle 26. The deflector plate includes a shaft section 31 that is sized to fit in the deflector plate receiving channel 25 of the nozzle top 22. The water stream flowing through the nozzle 26 is directed to the deflector plate 30, which is provided with a stream deflector surface 32 for turning and distributing the water stream. The stream deflector surface 32 is shaped to cause the deflector plate 30 to rotate when impacted with the water stream from the nozzle 26. The deflector plate 30 is displaceable in the nozzle top 22 of the nozzle module 18 between a retracted position (shown in FIGS. 2 and 4) and an extended position (shown in FIGS. 1 and 3). The deflector plate 30 also includes a torque shaft 34 extending from a side of the deflector plate 30 opposite from the side facing the nozzle 26.

The brake module 14 is secured in the first compartment 12 and includes a shaft 36 coupled with a rotatable connector 38. The brake module can be of any type suitable for the intended purpose. In some embodiments, the brake module is a viscous brake assembly including a rotor attached to the shaft 36 and disposed in a pool of viscous fluid 42. The rotor 40 and viscous fluid 42 serve to resist rotation of the shaft 36. The viscous brake assembly may also include a bearing 44 in which the shaft 36 is rotatable, and a seal 46 and retainer 48 to enclose and secure the assembly. Other types of brake assemblies may be incorporated into the brake module 14.

Figure 2:
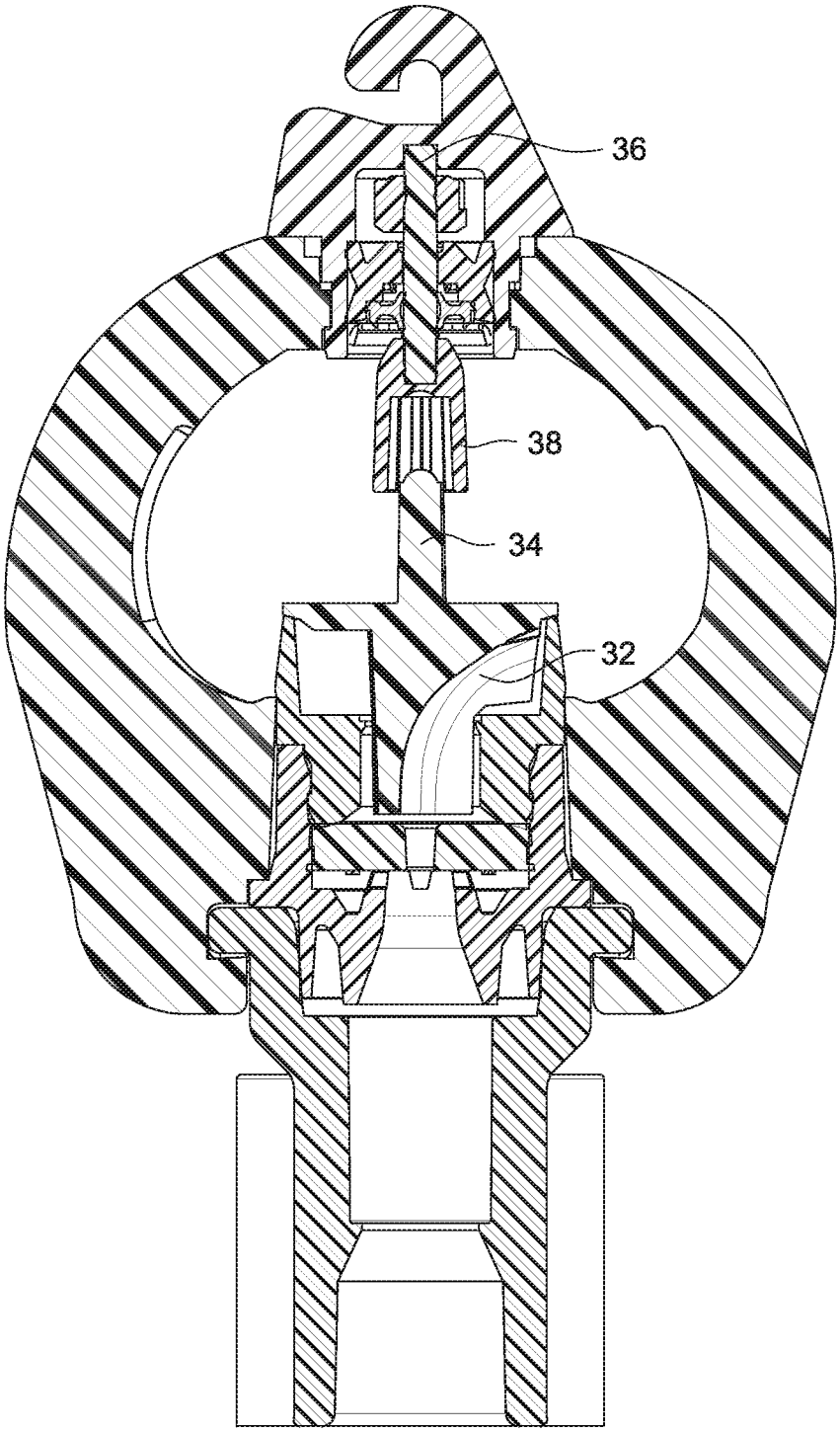
Figure 3:
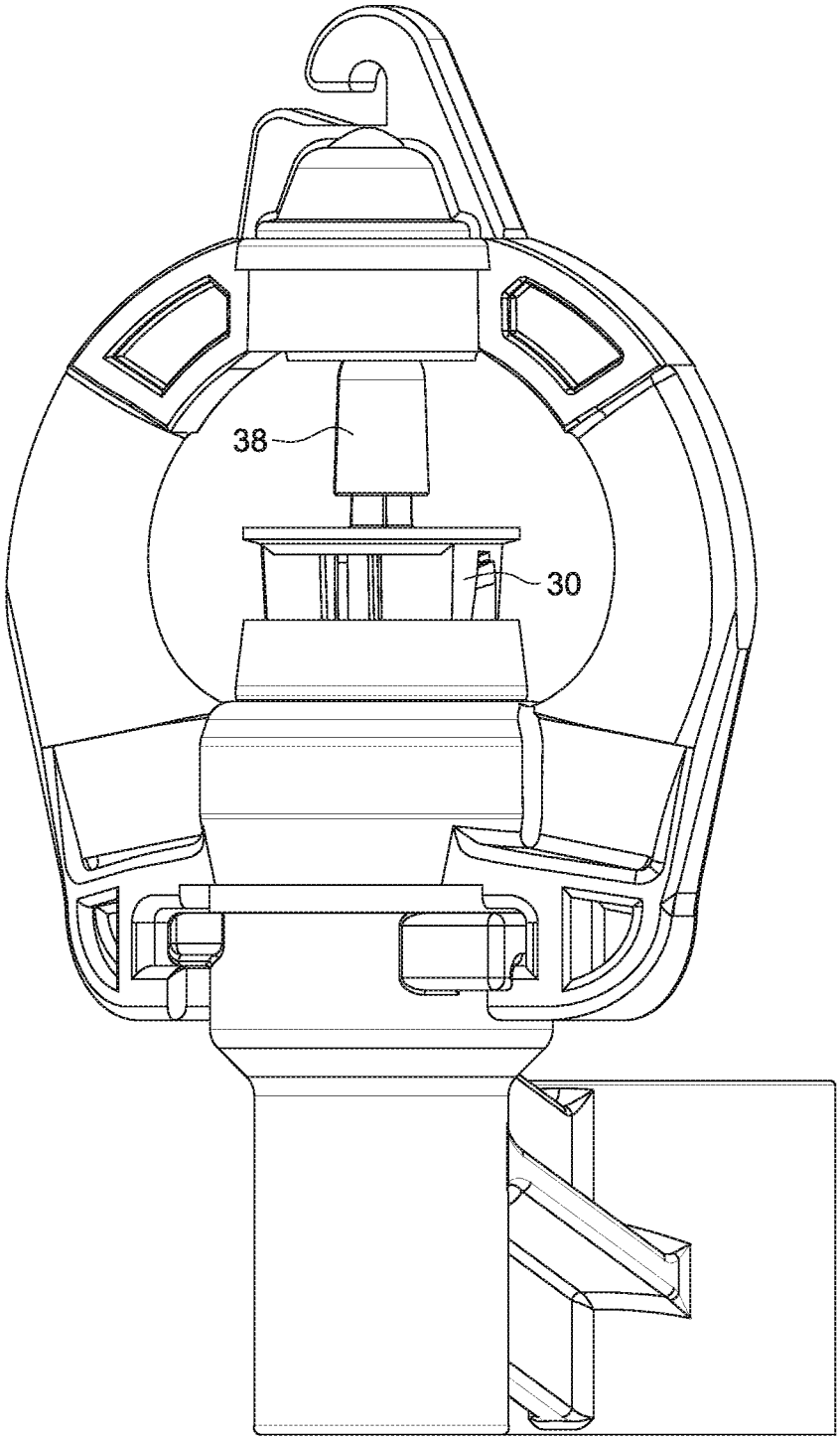
FIGS. 3 and 4 show the sprinkler assembly of FIGS. 1 and 2 with the deflector plate in an extended and a retracted position, respectively.
Figure 4:
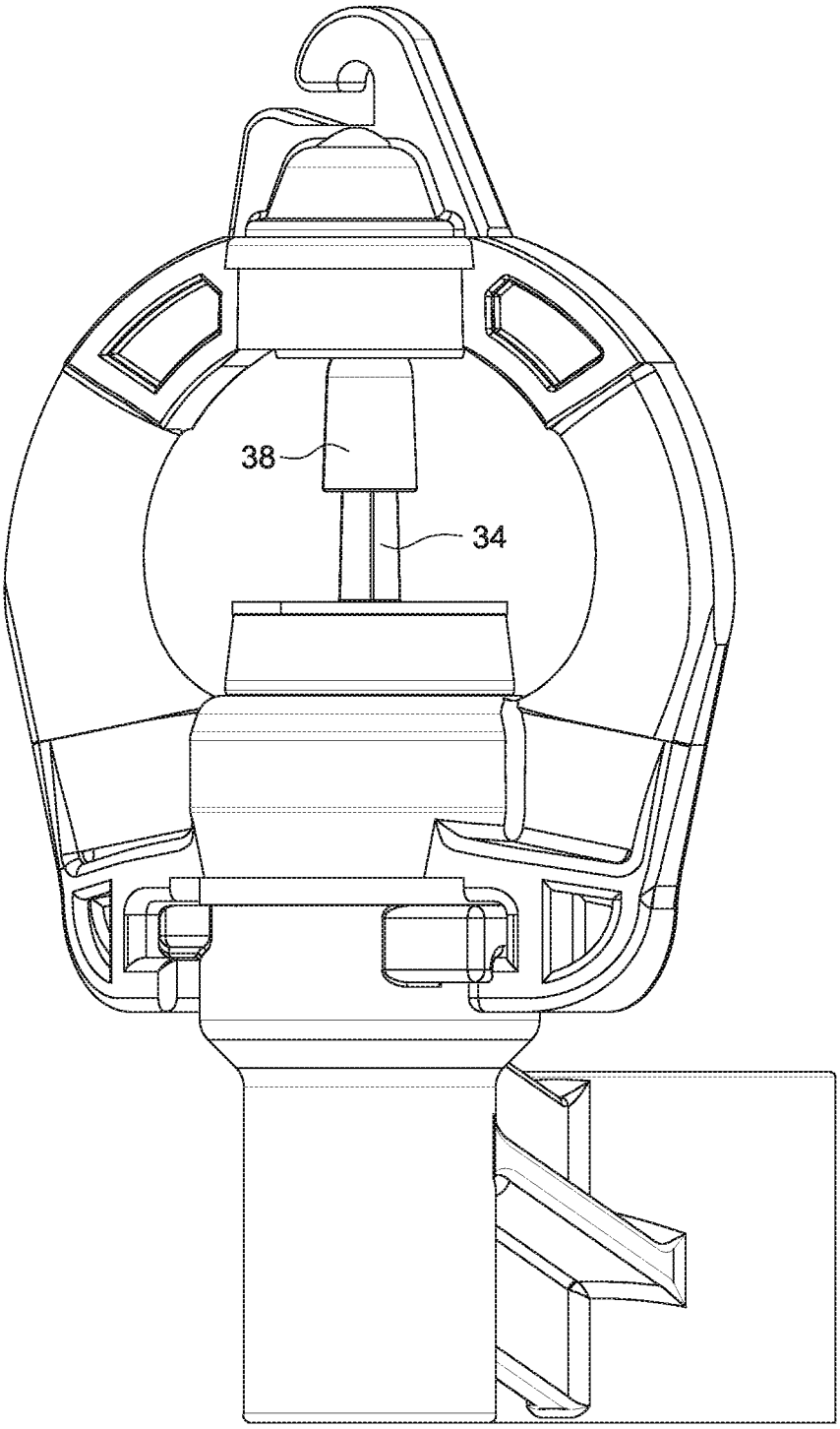
Figure 5:
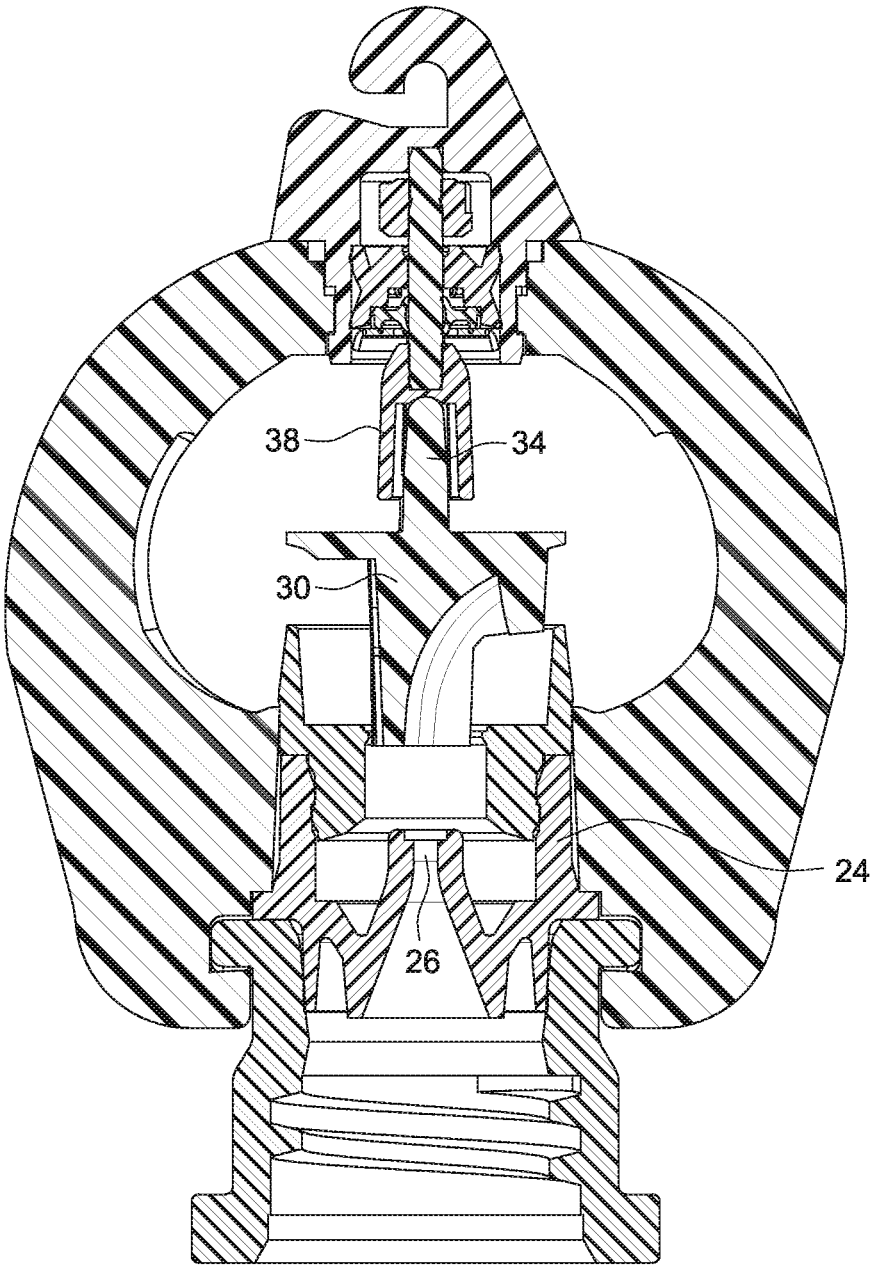
FIGS. 5-8 show a sprinkler assembly including available variations by virtue of the modular construction of the sprinkler assembly.
Figure 6:
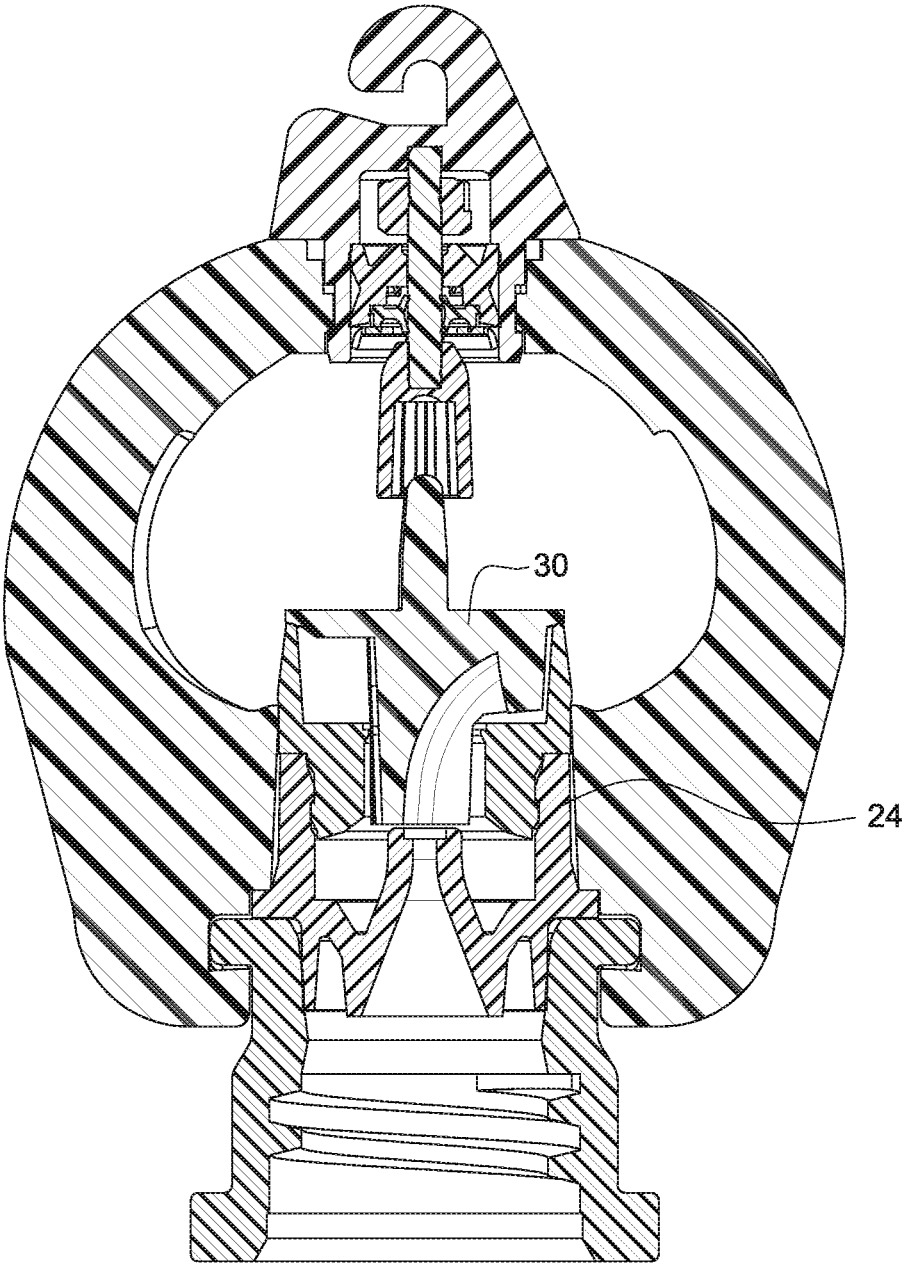
Figure 7:
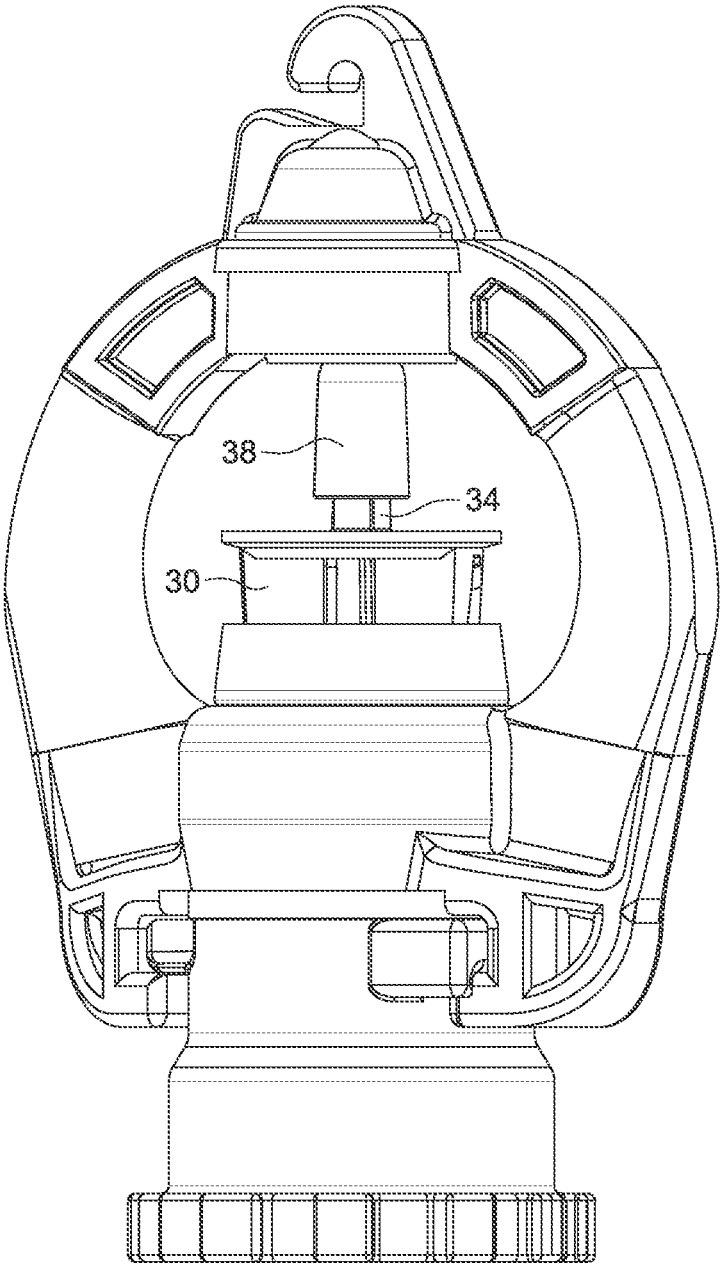
Figure 8:
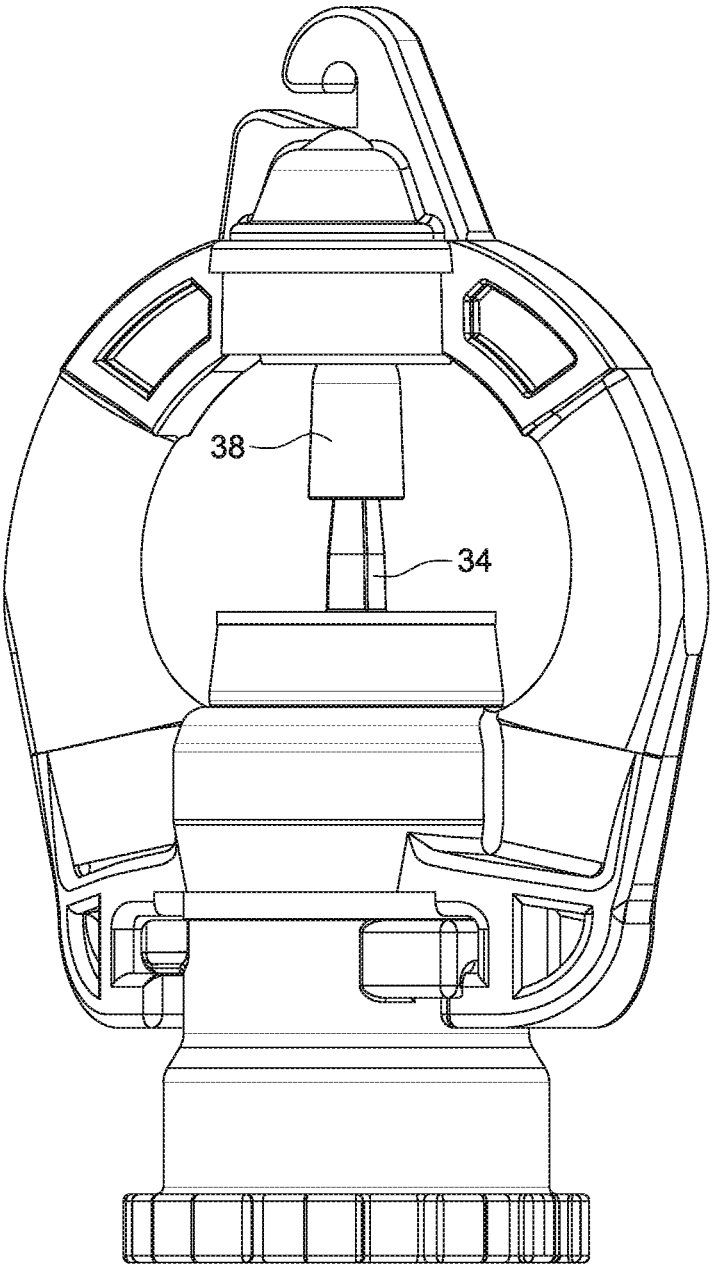
Figure 9:
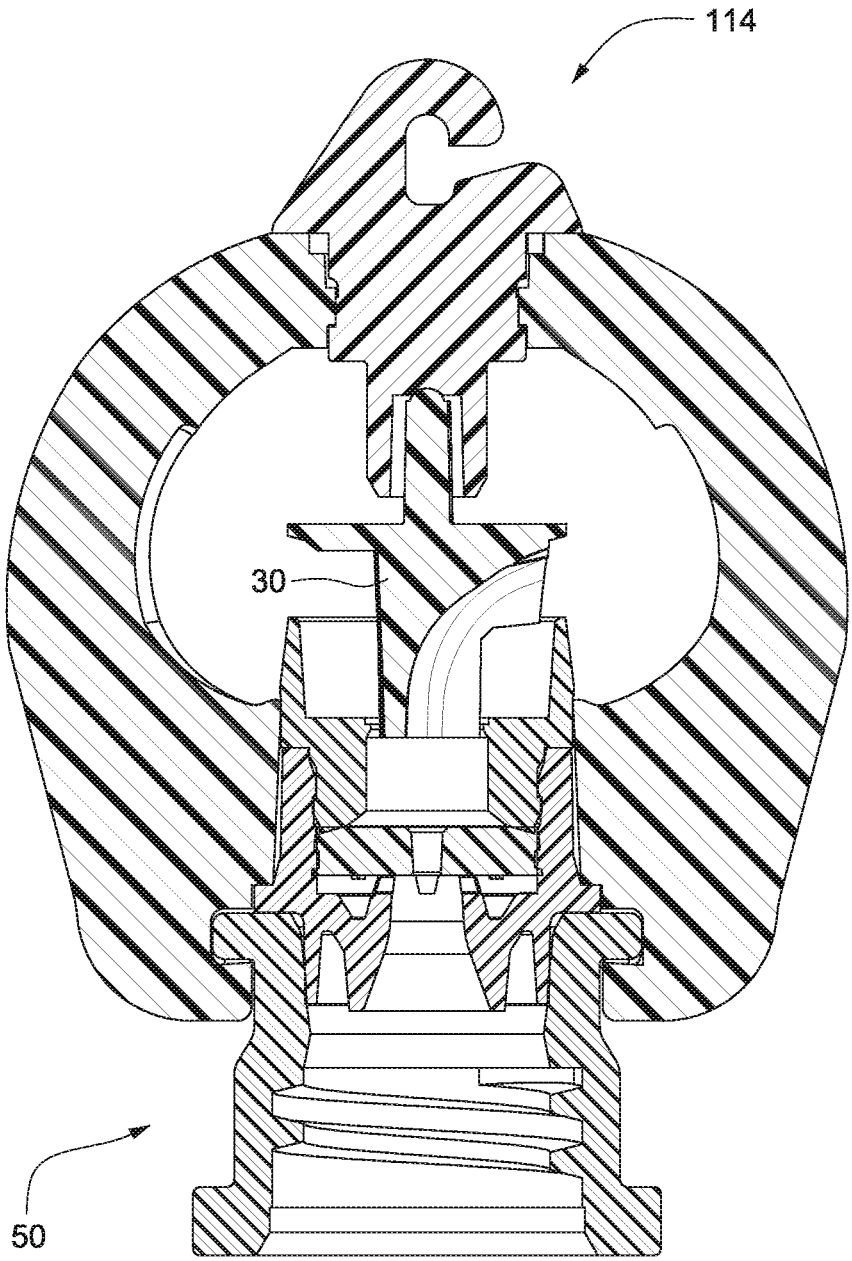
FIGS. 9-12 show a spinner variation of the sprinkler assembly.

With continued reference to FIGS. 1 and 3, the torque shaft 34 is engaged with the rotatable connector 38 in the extended position. The engagement between the torque shaft 34 and the rotatable connector 38 enables a mutual torque exchange between the torque shaft 34 and the rotatable connector 38. That is, the rotatable connector 38 may include a channel with a cross-sectional shape, where the torque shaft 34 is shaped corresponding to the cross-sectional shape to engage the channel and to transfer torque between the deflector plate 30 and the rotatable connector 38. In the embodiment shown in FIGS. 1 and 2, the cross-sectional shape includes ridges, where the torque shaft 34 includes splines that are engageable with the ridges. In FIGS. 3 and 4, the cross-sectional shape is square, and the torque shaft 34 is shaped to fit in the square shape. Any combination of cross-sectional shapes and torque shaft shapes may be utilized, and the invention is not necessarily meant to be limited to the illustrated variations. Other shapes and/or connection types may be used to achieve the intended functionality.

In some embodiments, the torque shaft 34 is engaged with the rotatable connector 38 in both the extended position and the retracted position. With such an engagement, the deflector plate 30 and the rotatable connector 38 are coupled before a water stream is emitted through the nozzle 26. In alternative embodiments, the torque shaft 34 is detached from the connector 38 in the retracted position (see the discussion below with reference to FIGS. 5-8). As a consequence, the deflector plate 30 begins to rotate freely at start-up until the torque shaft 34 engages the rotatable connector 38. This configuration may be desirable when a strong brake is utilized for a particular application. The spinning deflector plate can provide some momentum and kinetic energy before engaging the rotatable connector 38 to overcome a potentially difficult start.

With continued reference to FIGS. 1 and 2, the deflector plate 30 is displaceable between the retracted position and the extended position in the nozzle top 22. As shown, the rotatable connector 38 is positioned so as to act as a stop limit for the deflector plate 30 in the extended position. That is, the pop-up range of the deflector plate 30 is defined by the seat on the nozzle top 22 on which the deflector plate 30 is engaged in the retracted position (see FIG. 2) and the depth of the rotatable connector 38 in which the torque shaft 34 is disposed in the extended position (see FIG. 1). The deflector plate 30 may thus be simply placed in the nozzle top 22 during assembly without requiring an active connection.

To assemble the sprinkler, the nozzle module 18 may be snapped into the second compartment 16 of the sprinkler body 10, and the deflector plate 30 is set in the nozzle top 22. The brake module 14 may be secured in the first compartment 12 using any suitable connector such as a quarter-turn lock. This known type of lock is useful for connecting plastic pieces and utilizes tabs and ridges to secure parts with a quarter-turn or twist lock. The brake module 14 is installed such that the rotatable connector 38 is engaged or aligned with the torque shaft 34.

A similar quarter-turn lock or the like may be used to secure the assembly on a base unit 50. The base unit 50 includes connecting structure connectable with a source of water under pressure. In some embodiments, the base unit 50 includes a stake adapter or the like connectable via a quarter-turn lock. Alternatively, the base unit 50 may be threaded using a threaded Acme connector or may be press fit and glued.

In use, before a water stream flows through the nozzle 26, the deflector plate 30 is disposed in its retracted position as shown in FIGS. 2 and 4 by gravity. When water flows through the nozzle 26, the water stream impacts the stream deflector surface 32 and displaces the deflector plate 30 from the retracted position to the extended position as shown in FIGS. 1 and 3. The emitting stream also causes the deflector plate 30 to rotate by virtue of the shape of the stream deflector surface 32. In the extended position, the deflector plate 30 is prevented from freely rotating by the engagement between the torque shaft 34 and the rotatable connector 38, which in turn is coupled with the brake module 14. The amount of braking can be controlled depending on the intended application by interchanging one brake module with another. An alternative brake module may include a fluid with lower viscosity or no brake at all (resulting in a spinner configuration).

FIGS. 5-8 illustrate variations on the sprinkler assembly. In the illustrated variation, the torque shaft 34 is tapered such that the torque shaft 34 is disengaged from the rotatable connector 38 in the retracted position. The variation shown in FIGS. 5-8 also includes an alternative nozzle base 24 and standard nozzle 26 without the flow control washer 28 shown in FIG. 1.

Figure 10:
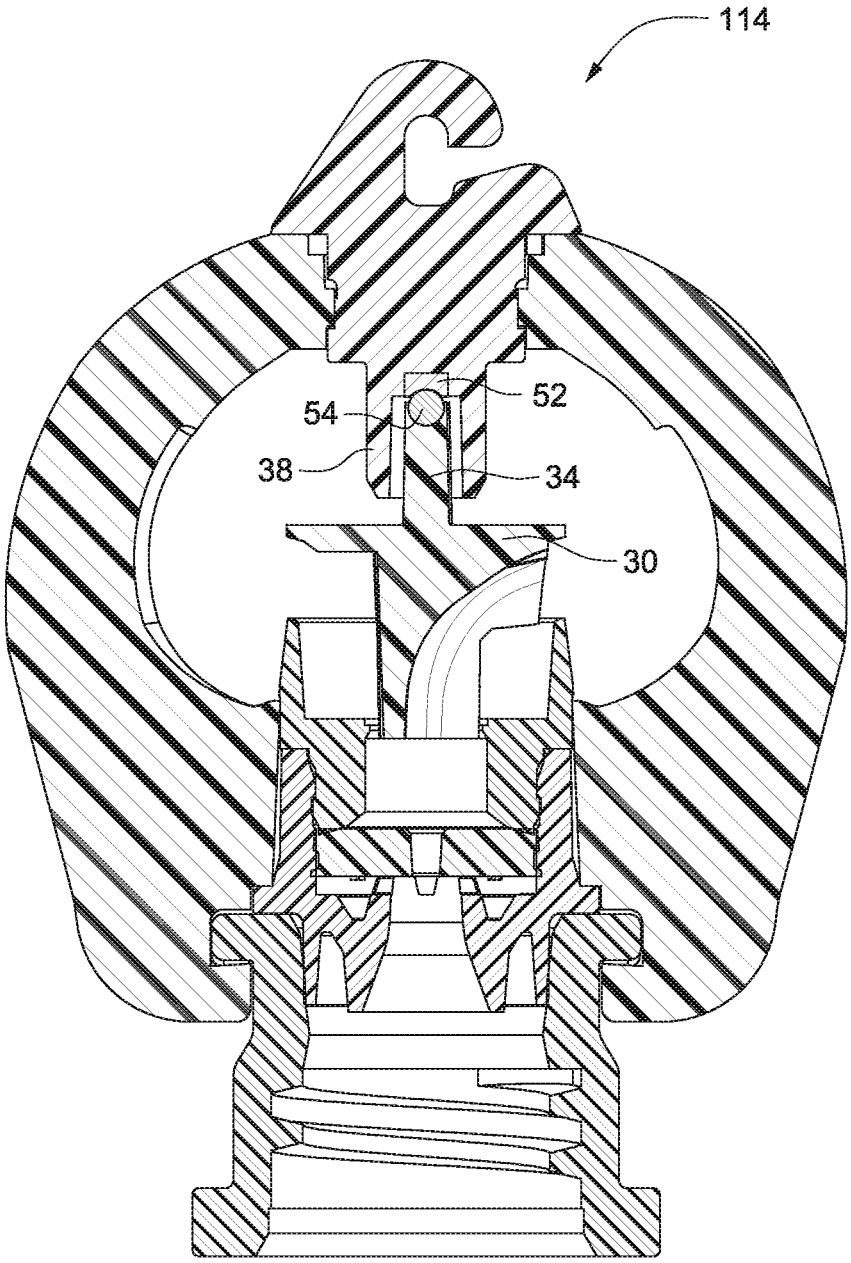
Figure 11:
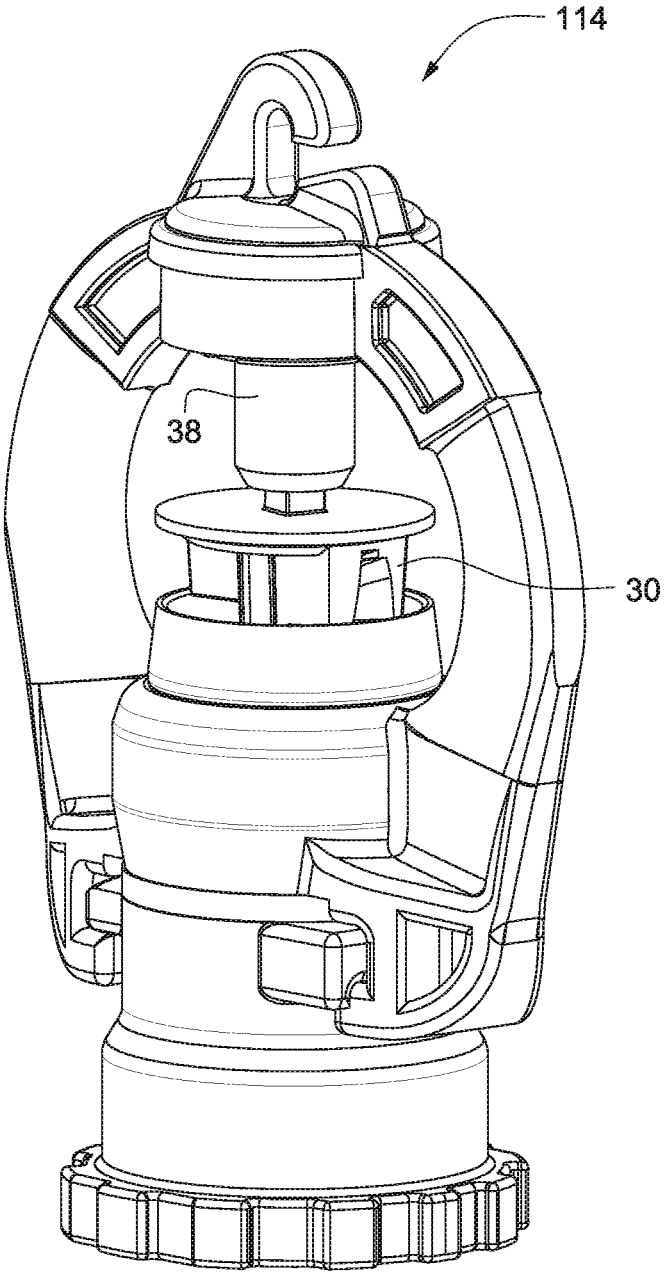
Figure 12:
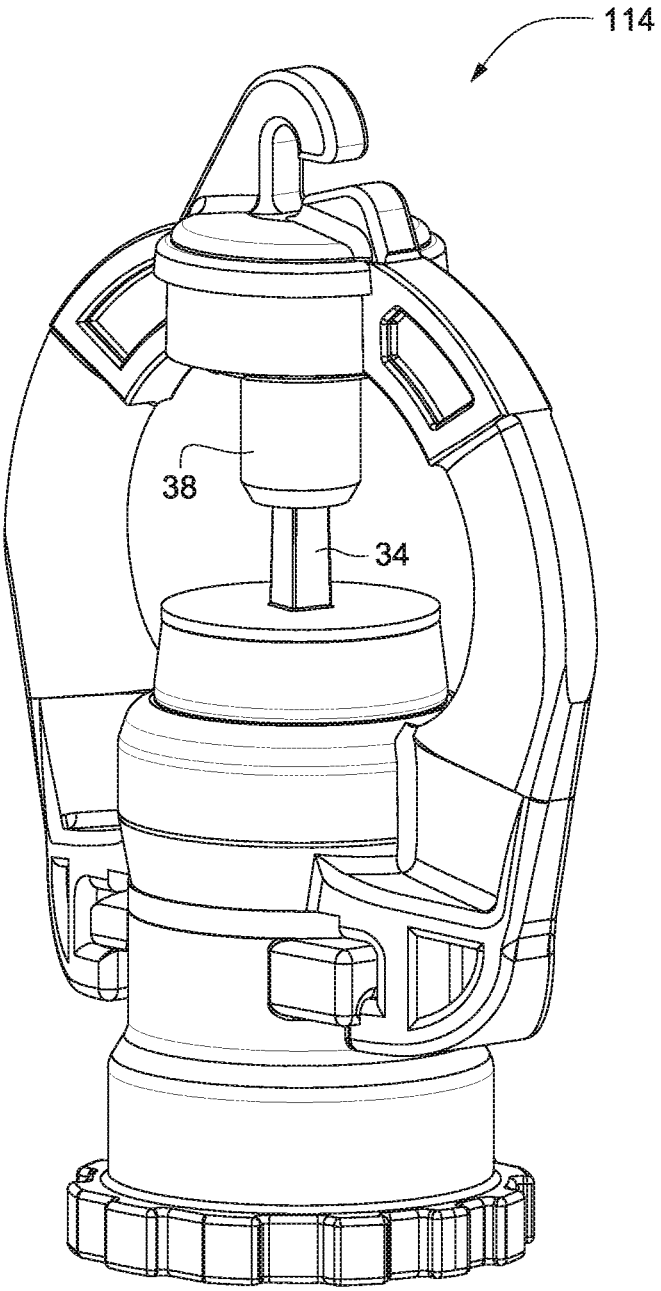
Figure 13:
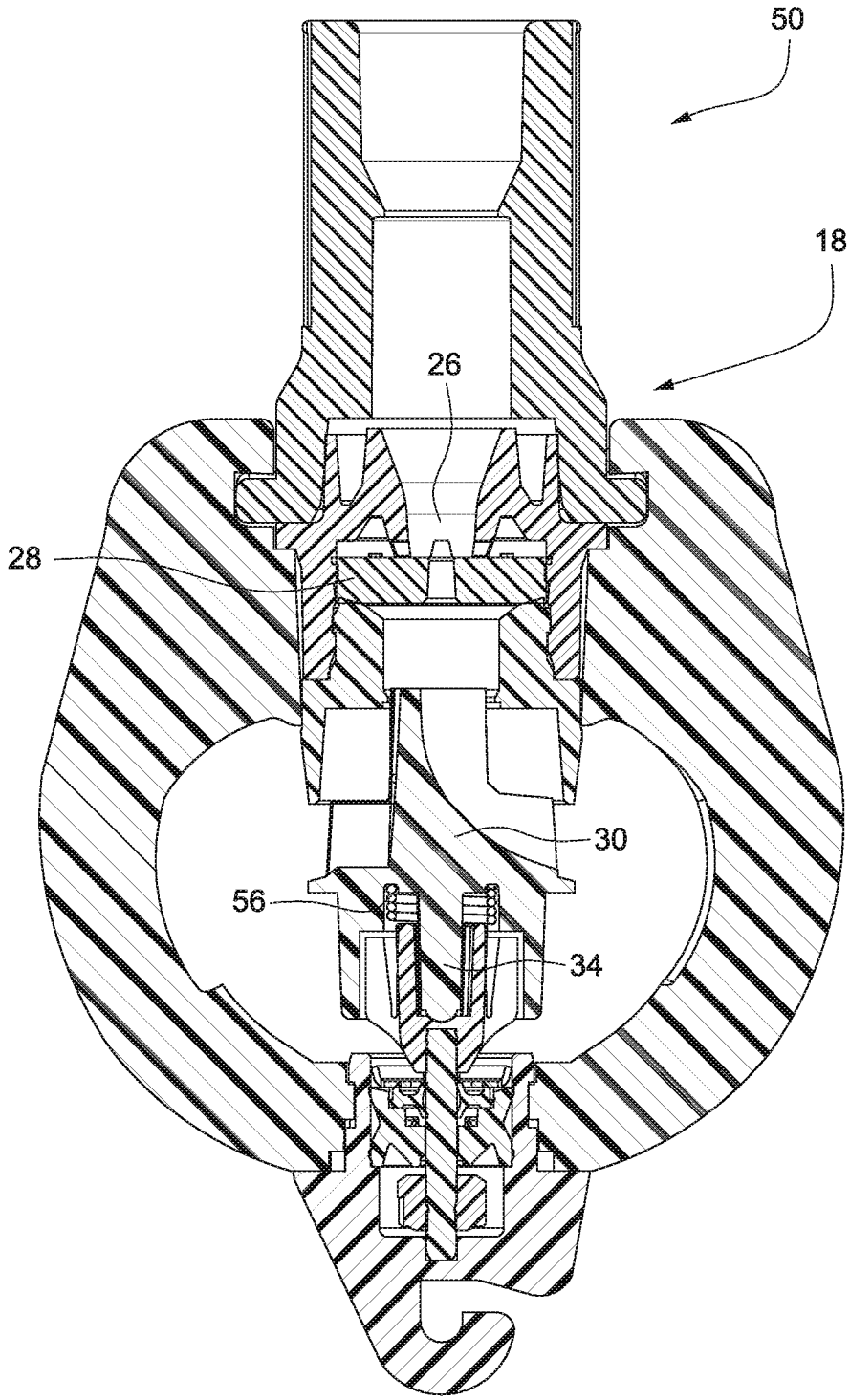
FIGS. 13-16 show a hanging rotator version of the assembly.

FIGS. 9-12 show a variation where the brake module 14 is replaced with a spinner module 114. In this variation, the deflector plate 30 is freely rotatable. As shown in FIG. 10, the spinner module 114 may include a jewel cup bearing 52 mounted in the rotatable connector 38 and/or a ball bearing 54 disposed at a distal end of the torque shaft 34 and engaged with the jewel cup bearing 52 with the deflector plate in the extended position. The bearings 52, 54 may be usable together or separately. The bearings 52, 54 can reduce wear and extend the life of the sprinkler in the spinner configuration. The variation shown in FIGS. 9-12 includes a threaded Acme adapter as the base unit 50.

Figure 14:
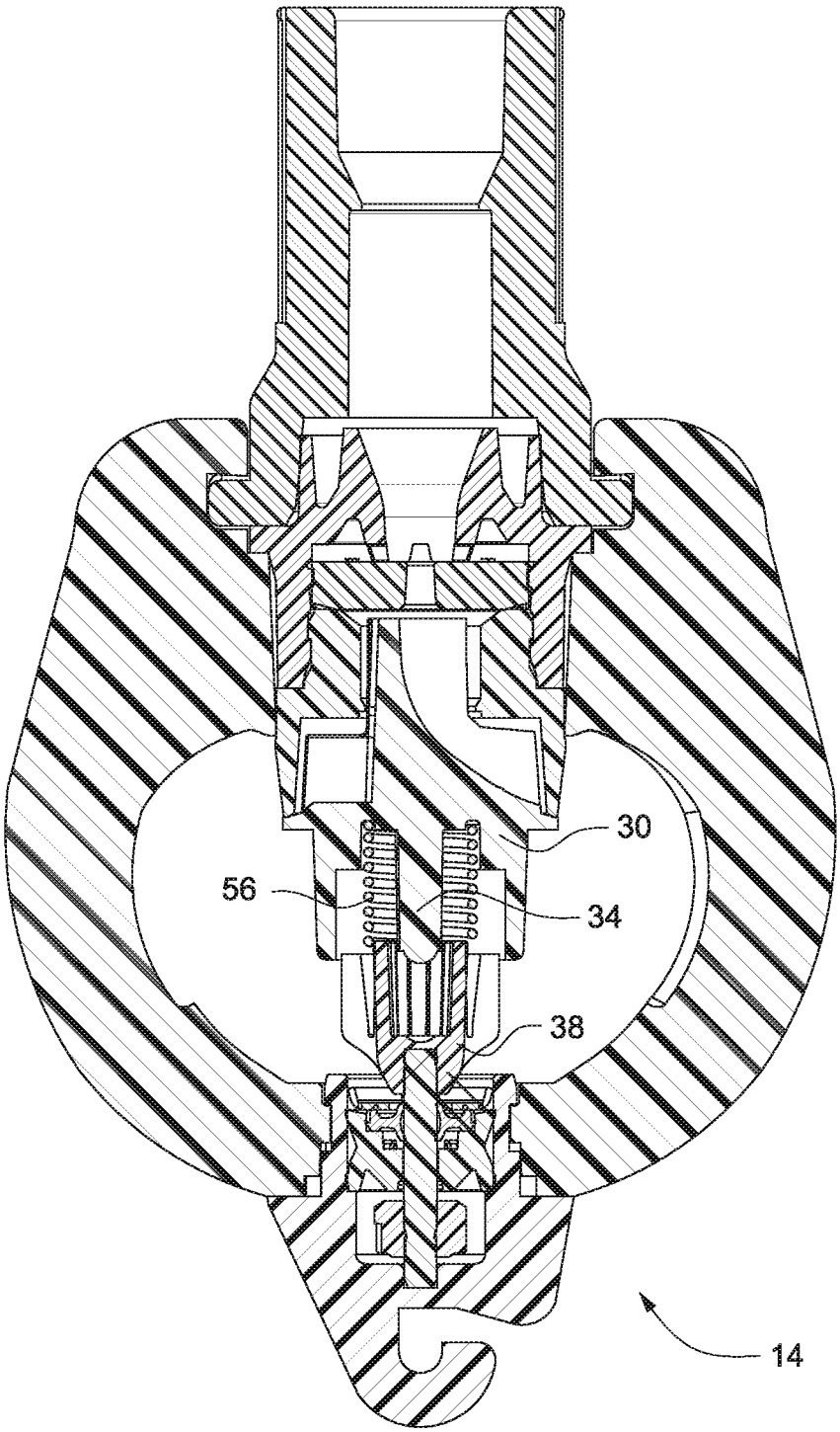
Figure 15:
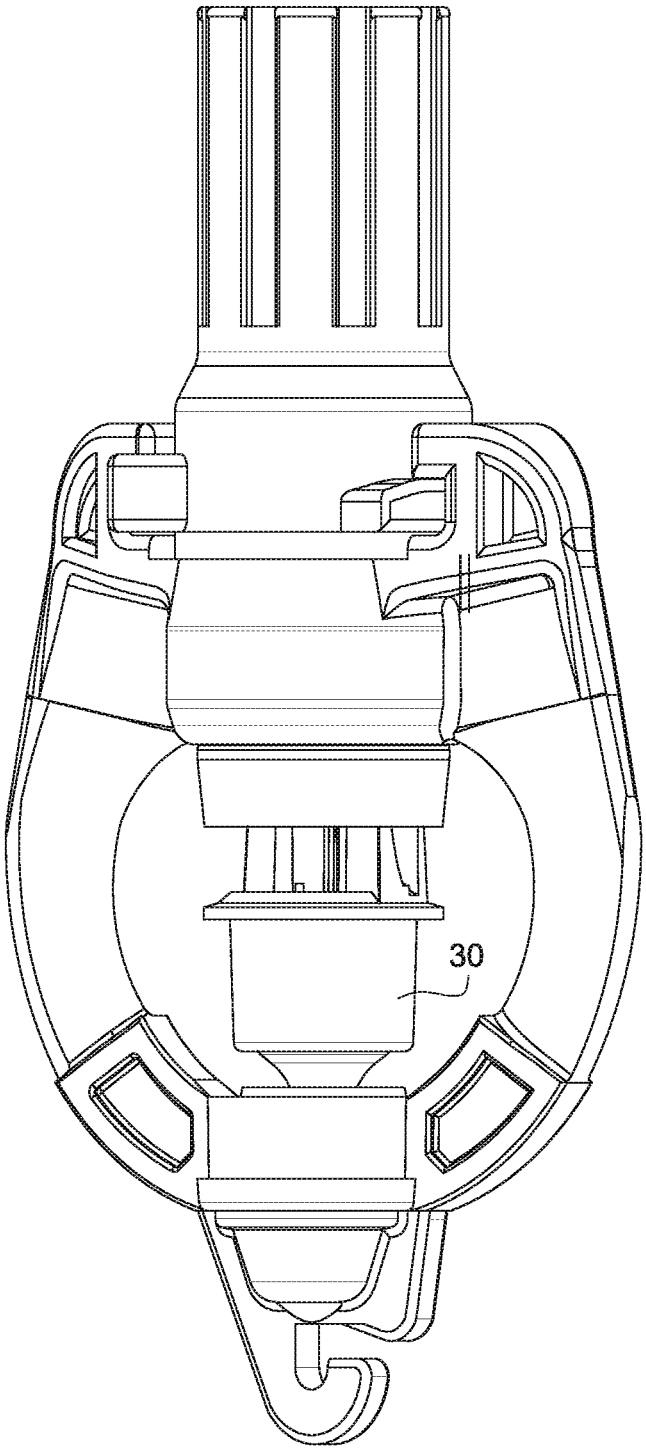
Figure 16:
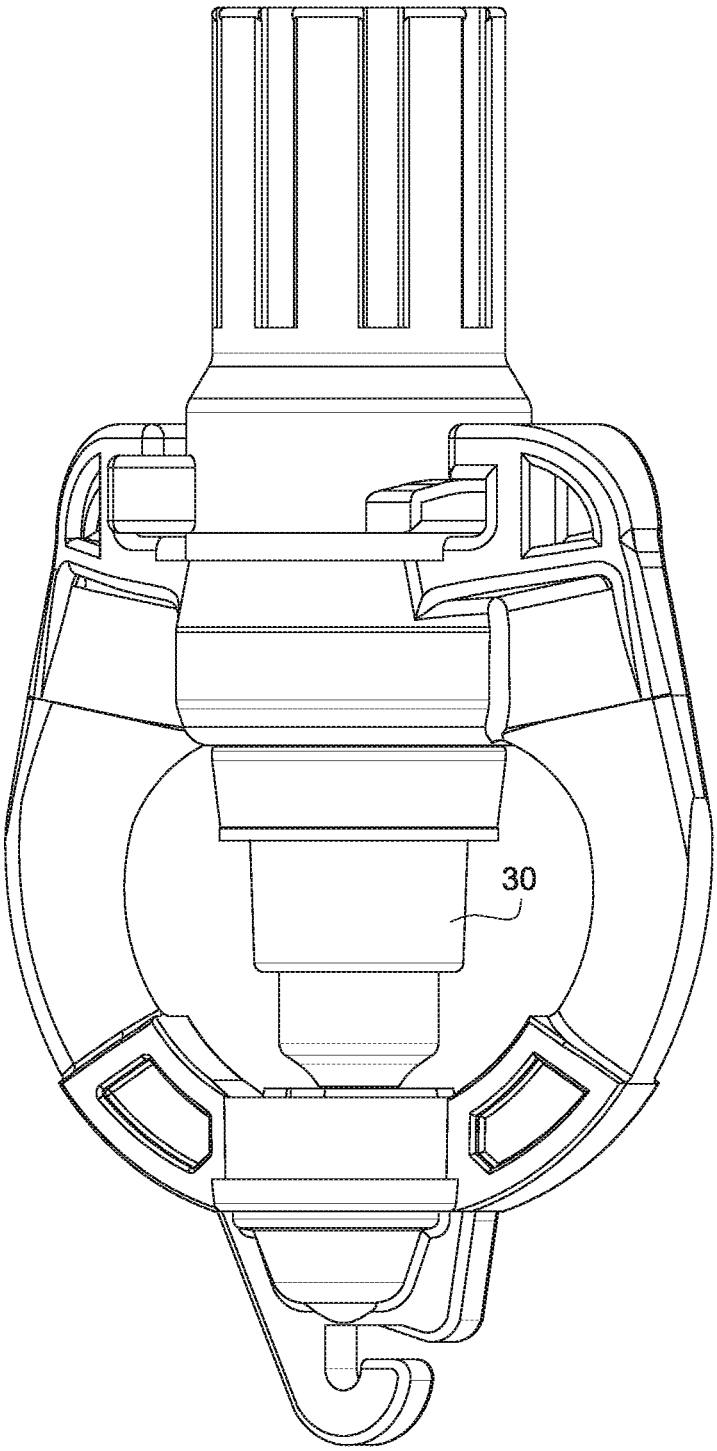

FIGS. 13-16 show a variation adapted for use as a hanging rotator. In this variation, the base unit 50 is top-mounted as shown. The nozzle module is shown with a flow control nozzle 26 and a flow control washer 28. A spring 56 is disposed over the torque shaft 34 and acts between the rotatable connector 38 and the deflector plate 30. The spring 56 biases the deflector plate 30 toward the retracted position as shown in FIGS. 14 and 16. A spring constant is selected so that the water stream emitted from the nozzle 26 impacts the deflector plate 30 and extends the deflector plate 30 from the retracted position to the extended position against the force of the spring 56. When the stream is turned off, the spring 56 draws the deflector plate 30 back to the retracted position. In this embodiment, it may be desirable to use a brake module with a reduced braking force (e.g., by using a fluid with a lower viscosity) so that the deflector plate 30 rotates faster during use. The faster rotation may be desirable in the hanging variation so that the sprinkler may maintain its center.

Figure 17:
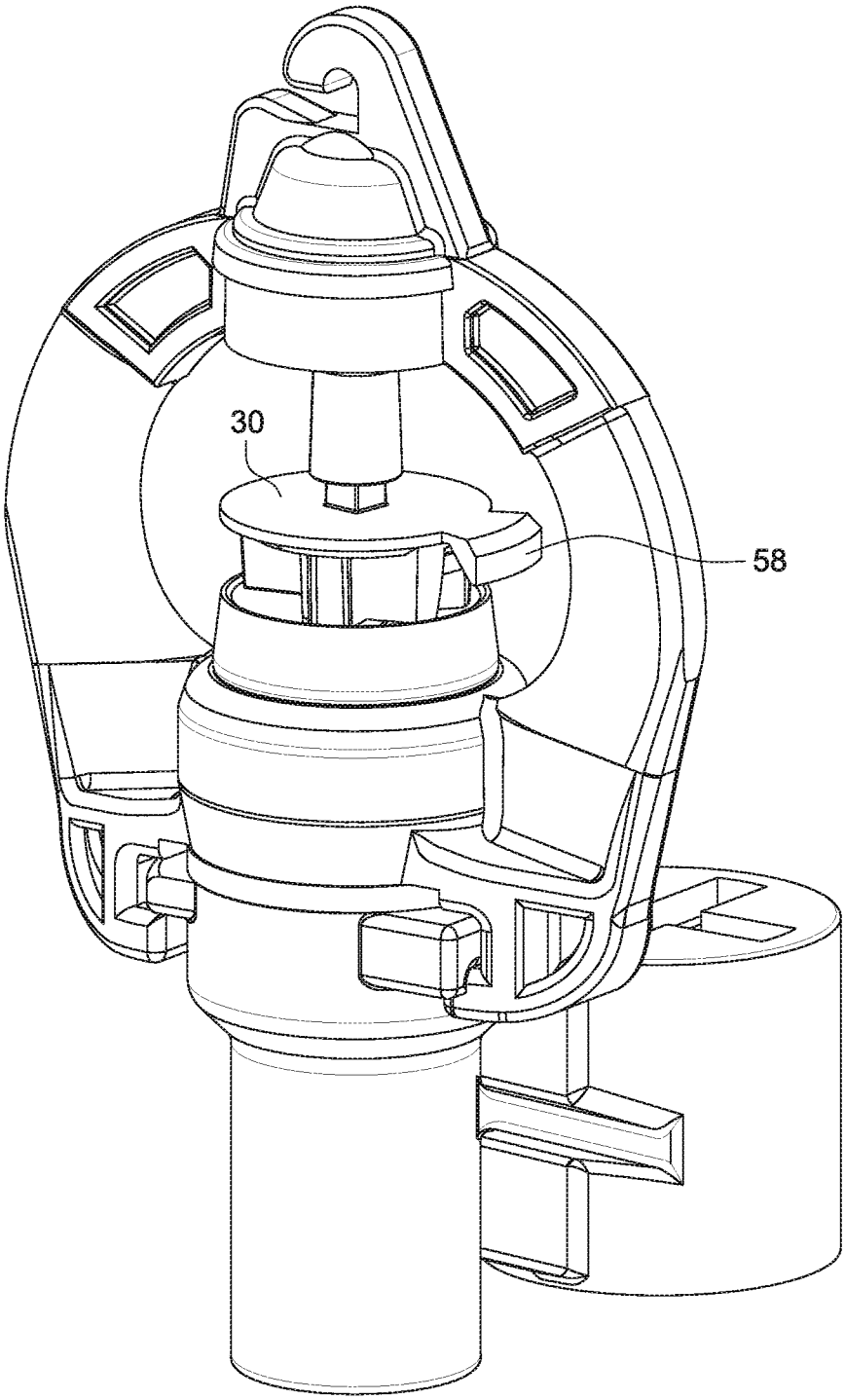
FIGS. 17 and 18 show a sprinkler assembly incorporating a short radius break-off tab for limiting a throw/disbursement range of the sprinkler.
Figure 18:
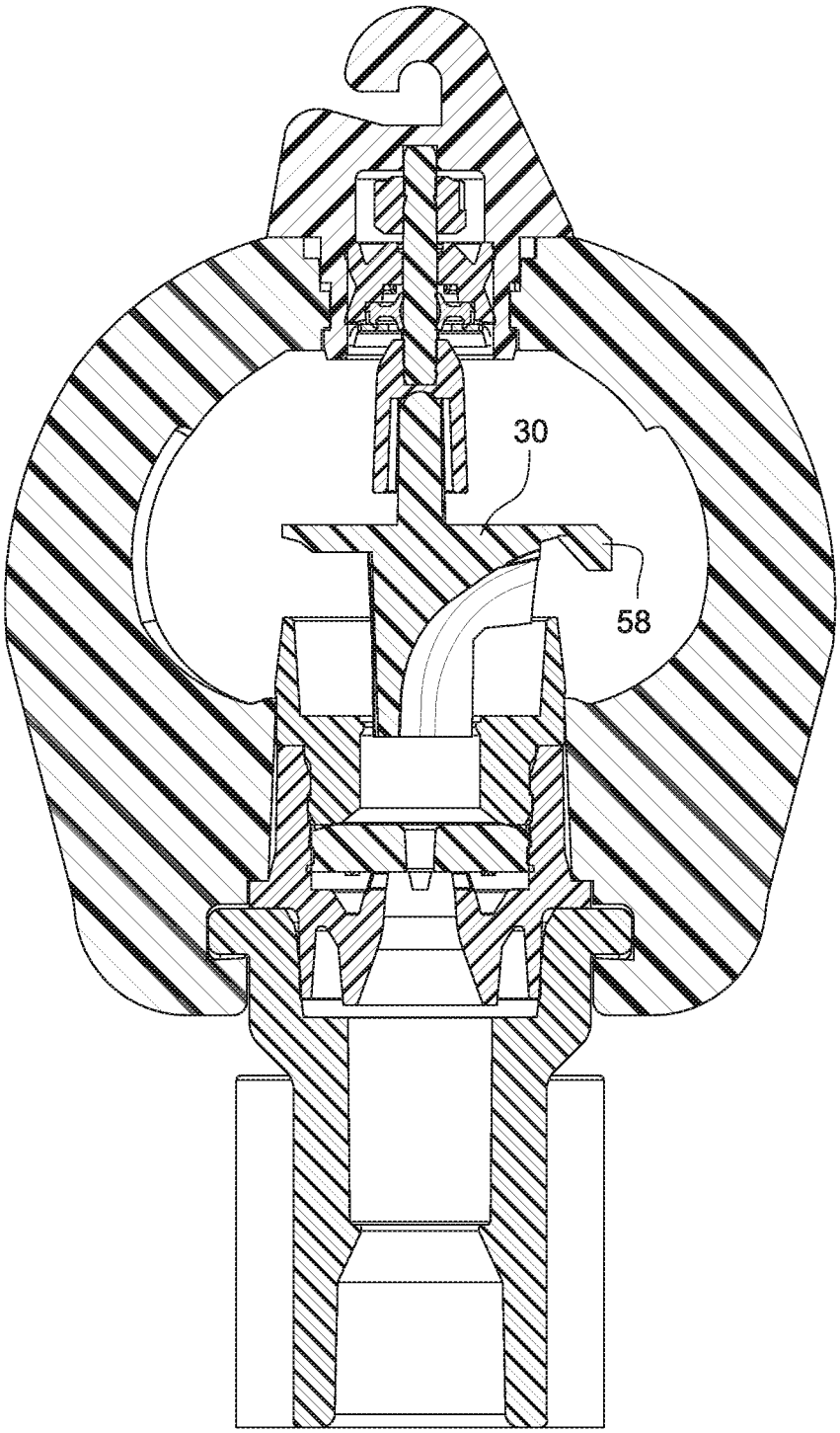

In some embodiments, it may be desirable to incorporate a breakaway diffuser tab on the deflector plate 30 as shown in FIGS. 17 and 18. The diffuser tab 58 serves to keep the water disbursement closer to the sprinkler for smaller vegetation or the like. As the vegetation grows, the breakaway diffuser tab 58 can be readily removed from the deflector plate 30. Alternatively, due to the modular construction of the sprinkler, the deflector plate 30 can be readily interchanged with a different deflector plate.

FIGS. 19-35 show a variation of the sprinkler assembly including an alternative positive engagement between the deflector plate and the rotatable connector. The components and general construction of the sprinkler assembly shown in FIGS. 19-35 are largely identical to the previously-described embodiments, and details of corresponding structural components will not be repeated.

Figure 19:
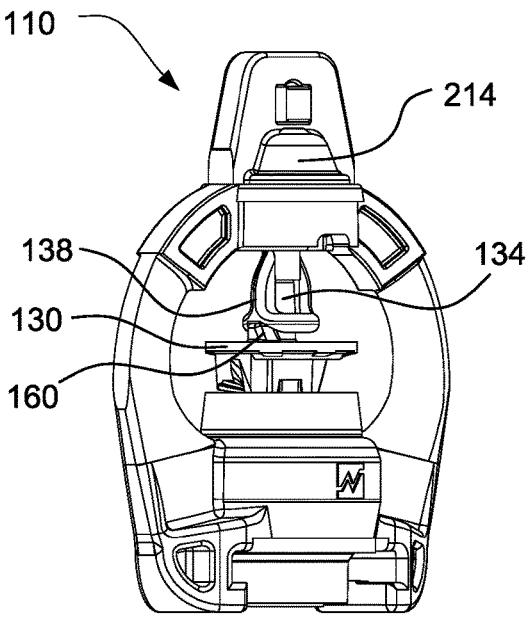
FIG. 19 shows a variation where the deflector plate includes a lug engaging a notch in the rotatable connector.
Figure 20:
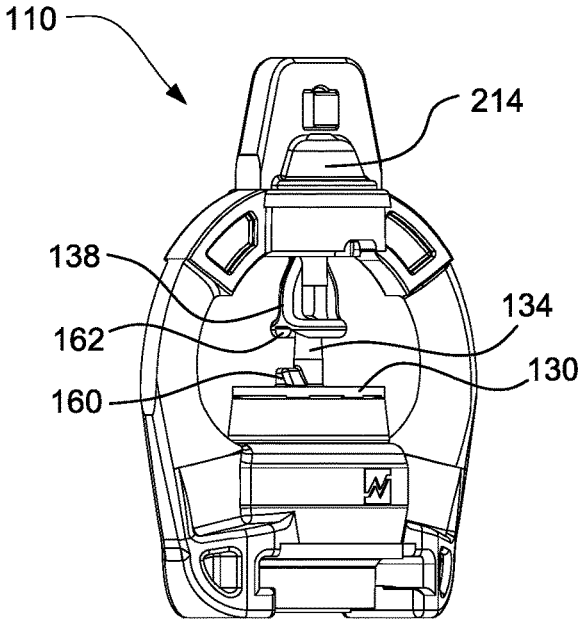
FIG. 20 shows the variation of FIG. 19 with the deflector plate in a retracted position.
Figure 21:
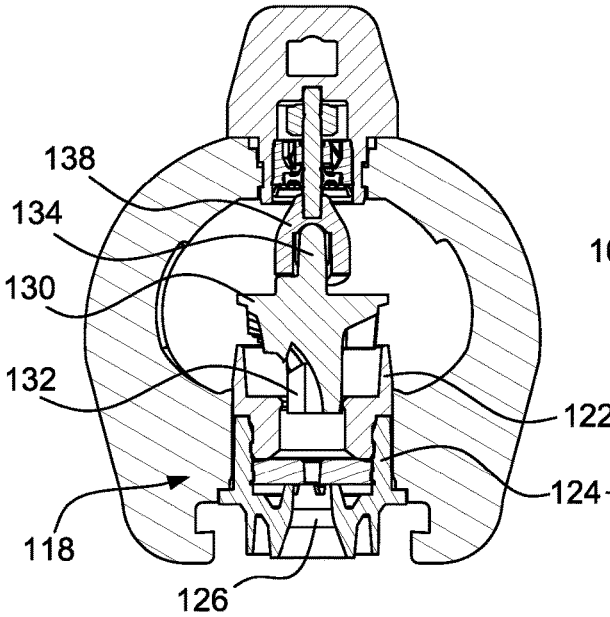
FIGS. 21 and 22 are cross-sectional views of the variation shown in FIGS. 19 and 20, respectively.
Figure 22:
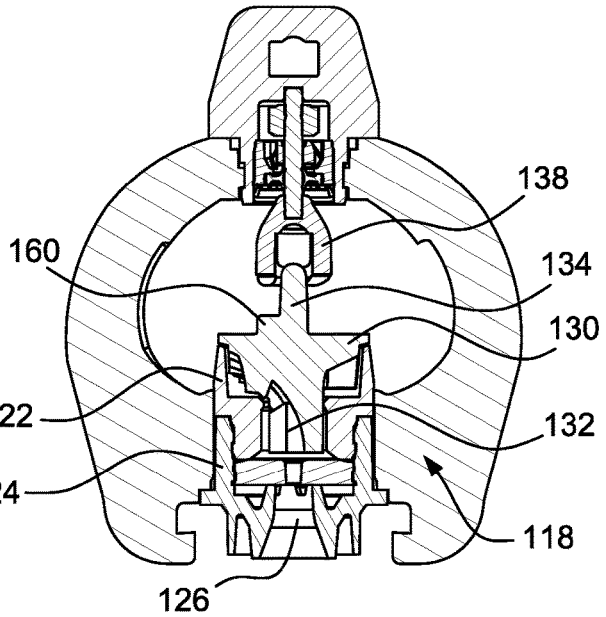

With reference to FIGS. 19-22, the sprinkler of this embodiment includes a sprinkler body 110 that serves as connecting structure for the modular components of an assembled sprinkler. A brake module 214 is secured to the sprinkler body 110 and includes a rotatable connector 138, coupled with a brake assembly contained in the brake module 214. The assembly also includes a nozzle module 118 supporting a nozzle 126. A pop-up deflector plate 130 disposed in a path of a stream emitted from the nozzle 126 is displaceable between a retracted position (FIGS. 20 and 22) and an extended position (FIGS. 19 and 21). As shown, the pop-up deflector plate 130 engages the rotatable connector 138 in the extended position.

The nozzle module 118 includes a nozzle top 122 engaged with a nozzle base 124. The deflector plate 130 is displaceable between the retracted position and the extended position in the nozzle top 122. As shown, the rotatable connector 138 is positioned so as to act as a stop limit for the deflector plate 130 in the extended position.

As with each of the described embodiments, the pop-up deflector plate 130 includes connecting structure that positively engages the rotatable connector 138 in the extended position. In the embodiment shown in FIGS. 19-35, the pop-up deflector plate 130 is configured to disengage from the rotatable connector 138 in the retracted position.

The deflector plate 130 is provided with a stream deflector surface 132 for turning and distributing the water stream. The stream deflector surface 132 is shaped to cause the deflector plate 130 to rotate when impacted with the water stream from the nozzle 126. The deflector plate 130 also includes a torque shaft 134 extending from a side of the deflector plate 130 facing the rotatable connector 138.

With continued reference to FIGS. 19-22, the deflector plate 130 is also provided with a connection member that engages the rotatable connector 138 in the extended position. In some embodiments, the connection member is in the form of a lug 160 on a side of the deflector plate 130 facing the rotatable connector 138. The rotatable connector 138 is provided with at least one notch 162 that is sized to receive the lug 160 such that the lug 160 engages the at least one notch 162 in the extended position. In the retracted position, the connection member or lug 160 is spaced from and disengaged from the rotatable connector 138.

Figure 23:
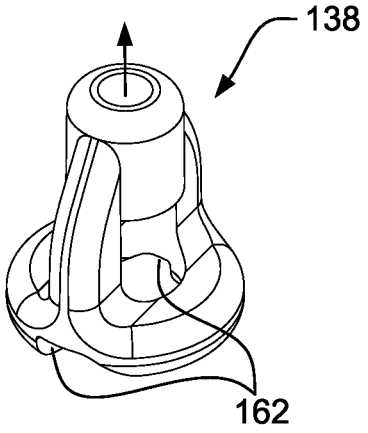
FIGS. 23 and 24 are perspective views of an exemplary rotatable connector.
Figure 24:
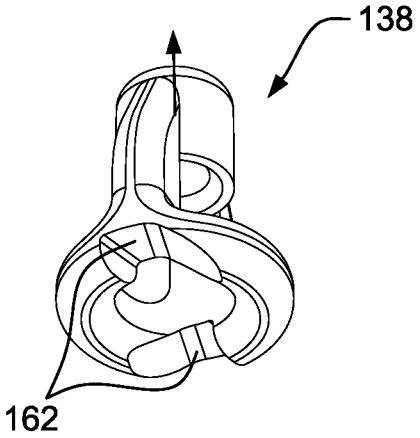
Figure 25:
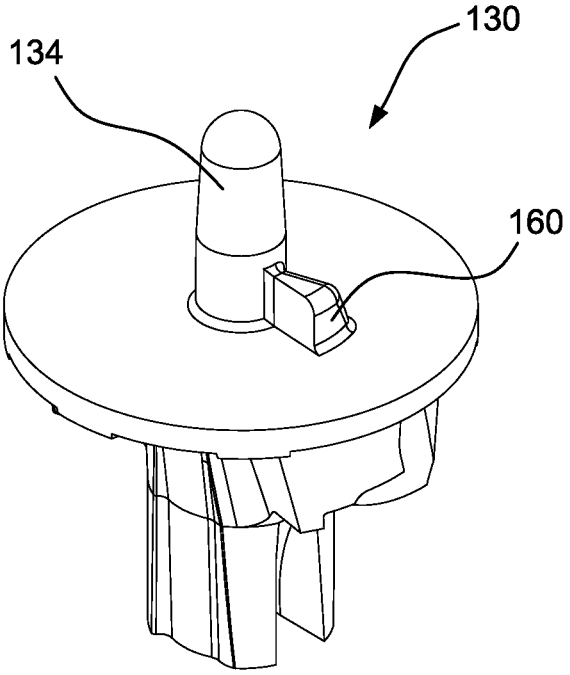
FIGS. 25 and 26 are perspective views of an exemplary deflector plate.
Figure 26:
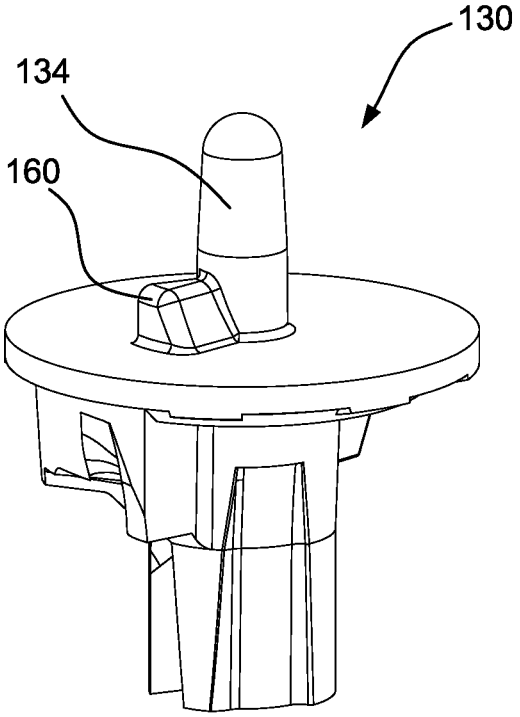
Figure 27:
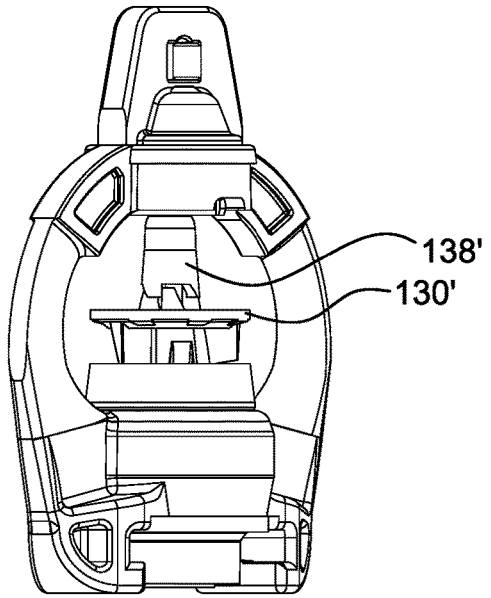
FIGS. 27 and 28 show an exemplary rotatable connector with a closed channel and the deflector plate including multiple lugs.
Figure 29:
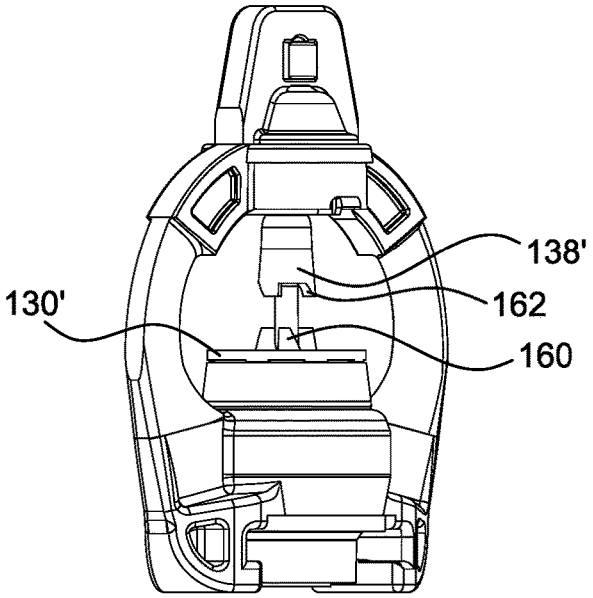
FIG. 29 shows the FIG. 27 variation with the deflector plate in a retracted position.
Figure 28:
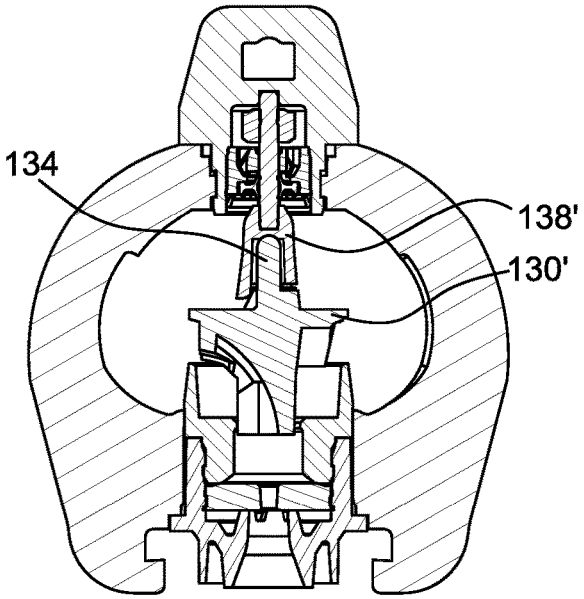
Figure 30:
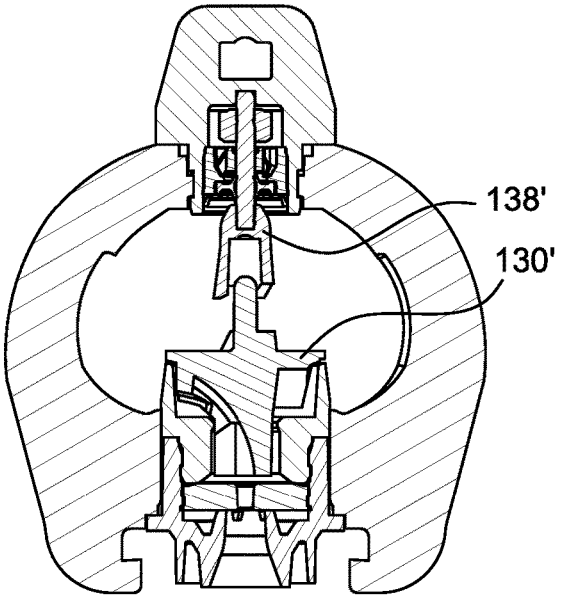
FIG. 30 is a cross-sectional view corresponding to FIG. 29.

FIGS. 23 and 24 are perspective views of the rotatable connector 138 including two notches 162 separated by 180 degrees. FIGS. 25 and 26 are perspective views of the deflector plate 130 showing the connection member or lug 160. In use, with the configuration shown, when water flows through the nozzle 126, the water stream impacts the stream deflector surface 132 and displaces the deflector plate 130 from the retracted position to the extended position as shown in FIGS. 19 and 21. The emitting stream also causes the deflector plate 130 to rotate by virtue of the shape of the stream deflector surface 132. As the deflector plate 130 extends and rotates, the lug 160 engages one of the notches 162, and the deflector plate 130 is thereby prevented from freely rotating by the engagement between the lug 160 and the notch 162 of the rotatable connector 138, which in turn is coupled with the brake module 214. The amount of braking can be controlled depending on the intended application by interchanging one brake module with another. An alternative brake module may include a fluid with lower viscosity or no brake at all (resulting in a spinner configuration).

Figure 31:
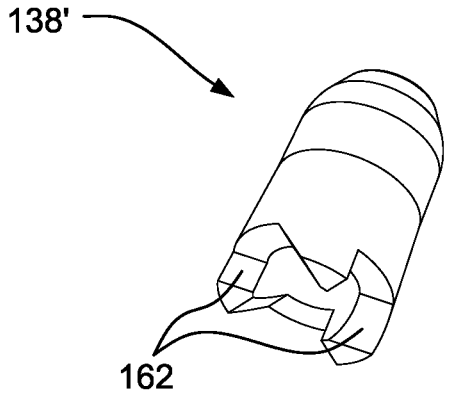
FIGS. 31-33 show the rotatable connector.
Figure 32:
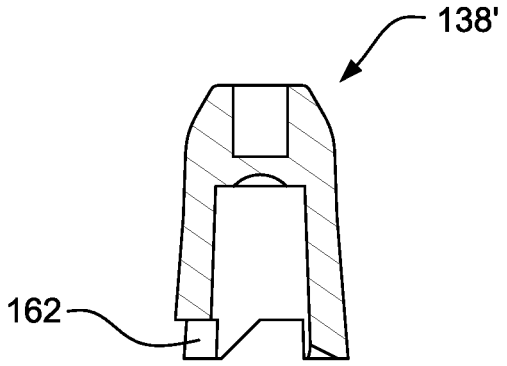
Figure 33:
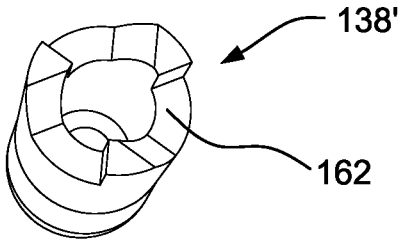
Figure 34:
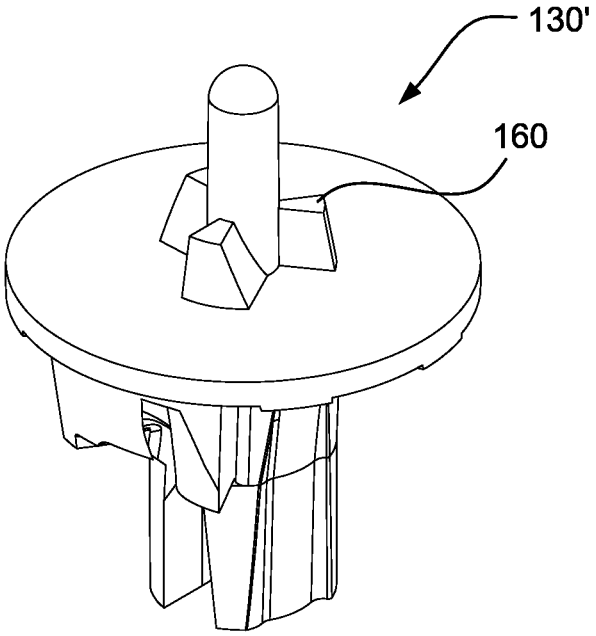
FIGS. 34 and 35 are perspective views of an exemplary deflector plate including multiple lugs.
Figure 35:
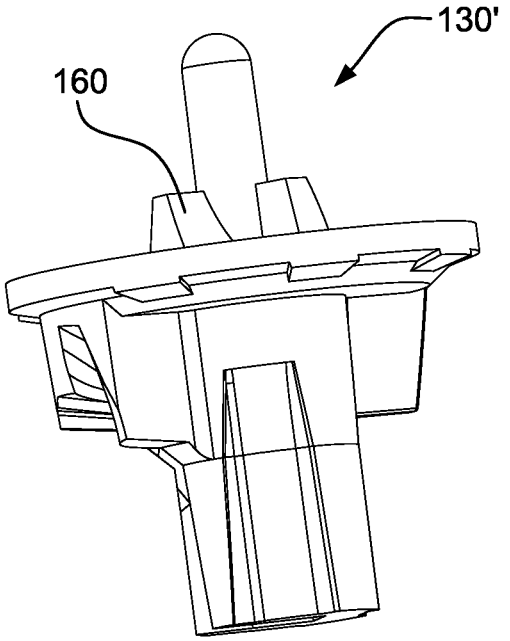

In some embodiments, the connection member may include a plurality of lugs on the side of the deflector plate 130 facing the rotatable connector 138. FIGS. 27-30 and FIGS. 34 and 35 show a deflector plate 130' including three lugs 160. The rotatable connector 138' shown in FIGS. 31-33 is provided with three notches 162 for receiving the lugs 160. The multiple lugs 160 and notches 162 provide for a more secure engagement between the deflector plate 130' and the rotatable connector 138'.

The rotatable connector 138 may define a channel in which the torque shaft 134 is received in the extended position. As shown in FIGS. 19-24, the channel may be an open channel; alternatively, as shown in FIGS. 27-33, the channel may be a closed channel. The open channel facilitates water flow through the rotatable connector 138 during use to prevent sand and dirt buildup and also to prevent spiders and other insects from building nests. The closed channel provides a more secure connection with the torque shaft 134 and provides for a sturdier component.

The modular construction of the described sprinkler facilitates assembly of the sprinkler into the numerous described variations as may be suitable for different intended functionalities. Thus, the assembly may include a plurality of brake modules with varying braking characteristics, a plurality of nozzle modules with varying flow characteristics, and a plurality of deflector plates with varying stream disbursement characteristics. The pluralities of brake modules, nozzle modules and/or deflector plates may be selectively and independently attachable to the sprinkler body. The varying braking characteristics extend from no braking to maximum braking as described. The nozzle modules may include nozzles having varying sizes to reflect the varying flow characteristics.

The sprinkler according to the described embodiments incorporates a pop-up deflector plate in a rotator assembly. Additionally, the modular construction enables the use of multiple variations according to intended functionality.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A sprinkler comprising:

a sprinkler body;

a brake module secured to the sprinkler body and including a rotatable connector coupled with a brake assembly;

a nozzle module cooperable with the sprinkler body and including a nozzle; and a deflector plate coupled with the nozzle module, the deflector plate being displaced in the nozzle module by impact with a water stream from the nozzle from a retracted position to an extended position, the deflector plate including a stream deflector surface, a torque shaft, and a connection member, wherein the connection member engages the rotatable connector in the extended position, and wherein in the retracted position, the connection member is spaced from and disengaged from the rotatable connector.

2. A sprinkler according to claim 1, wherein the connection member comprises a lug on a side of the deflector plate facing the rotatable connector.

3. A sprinkler according to claim 1, wherein the connection member comprises a plurality of lugs on a side of the deflector plate facing the rotatable connector.

4. A sprinkler according to claim 3, wherein the rotatable connector comprises a plurality of notches, and wherein the lugs engage the notches in the extended position.

5. A sprinkler according to claim 1, wherein the rotatable connector comprises a channel, and wherein the torque shaft is disposed in the channel in the extended position.

6. A sprinkler according to claim 5, wherein the channel is an open channel.

7. A sprinkler according to claim 5, wherein the channel is a closed channel.

8. A sprinkler according to claim 1, wherein the nozzle module comprises a nozzle top coupled with a nozzle base, and wherein the deflector plate is displaceable between the retracted position and the extended position in the nozzle top.

9. A sprinkler according to claim 8, wherein the rotatable connector is positioned so as to act as a stop limit for the deflector plate in the extended position.

10. A sprinkler comprising:

a sprinkler body;

a brake module secured to the sprinkler body and including a rotatable connector coupled with a brake assembly;

a nozzle; and a pop-up deflector plate disposed in a path of a stream emitted from the nozzle and displaceable from a retracted position to an extended position by impact with the stream, the pop-up deflector plate engaging the rotatable connector in the extended position, the pop-up deflector plate comprising a connecting structure, wherein the connecting structure positively engages the rotatable connector in the extended position and disengages from the rotatable connector in the retracted position.

11. A sprinkler according to claim 10, wherein the connecting structure comprises one of a torque shaft and a lug on a side of the pop-up deflector plate facing the rotatable connector.

12. A sprinkler according to claim 10, wherein the connecting structure comprises a lug on a side of the pop-up deflector plate facing the rotatable connector.

13. A sprinkler according to claim 12, wherein the rotatable connector comprises at least one notch, and wherein the lug engages the at least one notch in the extended position.

14. A sprinkler according to claim 10, wherein the connecting structure comprises a plurality of lugs on a side of the deflector plate facing the rotatable connector.

15. A sprinkler according to claim 14, wherein the rotatable connector comprises a plurality of notches, and wherein the lugs engage the notches in the extended position.

16. A sprinkler according to claim 10, further comprising a nozzle module secured to the sprinkler body and including a nozzle base containing the nozzle and a nozzle top in which the pop-up deflector plate is displaceable to and from the extended position.

17. A sprinkler according to claim 16, wherein the rotatable connector is positioned so as to act as a stop limit for the deflector plate in the extended position.

* * * * *